US005200582A

United States Patent [19]

Kraai, Jr. et al.

[11] Patent Number: 5,200,582

[45] Date of Patent: Apr. 6, 1993

[54] PASSIVE MUFFLER FOR LOW PASS FREQUENCIES

[75] Inventors: Leon A. Kraai, Jr., Jackson; Robert L. Sager, Jr., Grass Lake, both of Mich.

[73] Assignee: Tennessee Gas Pipeline Company, Lincolnshire, Ill.

[21] Appl. No.: 752,009

[22] Filed: Aug. 29, 1991

[51] Int. Cl.[5] ..... F01N 1/24

[52] U.S. Cl. ..... 181/256; 181/264; 181/272

[58] Field of Search ..... 181/249, 252, 256, 272, 181/255, 264

[56] References Cited

U.S. PATENT DOCUMENTS

| | | | |
|---|---|---|---|
| 2,039,800 | 5/1936 | Jack | 181/252 |
| 2,059,487 | 11/1936 | Peik | 181/252 |
| 2,311,676 | 2/1943 | Maxim | 181/252 |
| 2,326,612 | 8/1943 | Bourne | 181/252 |
| 3,109,511 | 11/1963 | Slayter et al. | 181/252 |
| 3,175,640 | 3/1965 | Matsui | 181/252 |
| 3,556,735 | 1/1971 | Epelman | 181/252 |
| 4,074,975 | 2/1978 | Tokura et al. | 181/272 |
| 4,523,662 | 6/1985 | Tanaka et al. | 181/249 |
| 4,589,517 | 5/1986 | Fukuda | 181/265 |
| 4,607,721 | 8/1986 | Tanaka et al. | 181/249 |
| 4,607,722 | 8/1986 | Tanaka et al. | 181/252 |
| 4,700,805 | 10/1987 | Tanaka et al. | 181/265 |

OTHER PUBLICATIONS

"Basic Acoustics and Noise Control" Seminar at Walker Manufacturing, Nov. 6–8, 1989, pp. 32, 33, 34, 37 and 38, by J. Bolton and J. Jones.

*Primary Examiner*—Michael L. Gellner
*Assistant Examiner*—Eddie C. Lee
*Attorney, Agent, or Firm*—Harness, Dickey & Pierce

[57] ABSTRACT

This invention relates to sound attenuating mufflers, and more particularly to sound attenuating mufflers for dampening sound waves of various frequencies above a pre-selected cut-off frequency. Specially positioned acoustical insulation is provided to partially attenuate sound waves of a relatively low frequency. The insulation is carried in a chamber having one dimension of sound wave travel on the order of one-tenth the wavelength of a preselected cutoff frequency above which sound attenuation is desired. An adjacent chamber substantially free of insulation has one dimension of sound wave travel on the order of one-quarter wavelength of the cutoff frequency.

17 Claims, 2 Drawing Sheets

PASSIVE MUFFLER FOR LOW PASS FREQUENCIES

BACKGROUND OF THE INVENTION

1. Field of the Invention

This invention relates to sound attenuating mufflers and, more particularly, to sound attenuating mufflers for damping sound waves of various frequencies.

2. Discussion

Automotive mufflers are incorporated in exhaust systems to limit the audible level of sound waves produced as a result of engine operations. Often automotive mufflers are provided with some type of heat resistant fibrous material such as glass, steel wool or a porous ceramic to absorb sound waves. This type of muffler, generally referred to as an absorbent type of muffler typically comprises a pipe perforated with numerous holes for the passage of the gases, and a pipe larger in diameter than the perforated pipe and receiving the latter in its axial bore. The tubular space defined by the inner and outer pipes is filled with the permeable and heat resistant material which serves to absorb the sound waves.

The prior art muffler systems have proven to be relatively ineffective at attenuating sound waves having drastically varying frequencies. Also, because of the arrangement of the porous absorbent material, the absorbent material is apt to break down over time significantly limiting the functionality and life span of the muffler.

SUMMARY OF THE INVENTION

In accordance with the teachings of the present invention, a sound attenuating muffler for exhaust gas comprises a housing, at least one exhaust inlet tube and at least one exhaust outlet tube extending through an outer surface of the housing, first and second transverse perforated partitions within the housing extending across an interior dimension of the housing transverse to a flow of sound waves propagating therein and arranged such that a gap is provided between the partitions, an exhaust receiving chamber defined between a first housing outer surface portion and the first partition, and a sound chamber defined between the second partition and a second housing outer surface portion.

BRIEF DESCRIPTION OF THE DRAWINGS

For a more complete understanding of the present invention, reference may be made to the following detailed description taken in conjunction with the accompanying drawings in which.

DETAILED DESCRIPTION OF THE PREFERRED EMBODIMENTS

Figure 1:
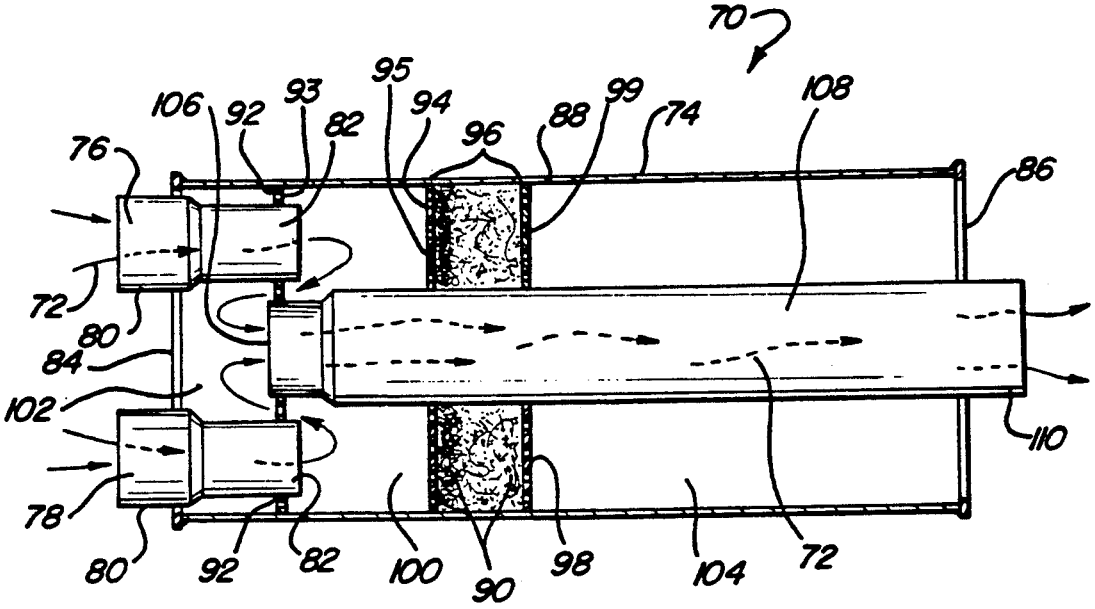
FIG. 1 is a side elevation view in cross-section of a muffler assembly incorporating diametrically positioned acoustic insulation arranged in accordance with the principles of the invention.

Referring to FIG. 1, a side elevation view of a sound attenuating muffler assembly 70 which incorporates diametrically positioned acoustical insulation 90 is shown in cross-section. Exhaust gas, demonstrated by arrows 72, and accompanying sound waves produced as a result of internal combustion engine operations enter into the muffler housing 74 via inlet tubes 76 and 78. These inlet tubes attach to pipes (not shown) which extend from an engine manifold at a leading end 80 and protrude through a first end wall 84 of the muffler housing 74. The trailing end 82 of the inlet tubes 76 and 78 penetrate through a partition 92 transversely positioned within the housing whereby the partition 92 serves to secure the tubes within the housing 74. The housing 74 is comprised of the first end wall 84, a second end wall 86 and a third lateral wall 88 extending between the two end walls.

An exhaust gas expansion chamber 100 is defined by the housing area located between the first transverse partition 92 and a second transverse partition 94. As the exhaust gas and sound waves exit the inlet tubes 76 and 78 they temporarily enter into expansion chamber 100. Chamber 100 acts as an acoustic expansion chamber causing attenuation of certain frequencies. As expansion chamber 100 begins to fill with exhaust gas the exhaust gas is forced out of the expansion chamber 100 through perforations 93 in the first partition 92 into a second exhaust gas receiving chamber 102. This receiving chamber 102 is defined by the area within the housing between the first transverse partition 92 and the first end wall 84. Chamber 102 also fills with exhaust gas until it is so full that the gas is forced out through an outlet tube 108 which extends into the receiving chamber 102.

The sound waves which initially enter the muffler housing 74 along with the exhaust gas travel a different course once inside the expansion chamber 100. The sound waves pass from expansion chamber 100 through perforations 95 in the second transverse partition 94 and into a gap 96 which is defined by the area within the muffler housing 74 between the second transverse partition 94 and a third transverse partition 98. Generally, the perforations 95 in the second partition 94 are on the order of 0.120 inches in diameter and provide the second partition 94 with an open surface area in the range of approximately 30%–70%. Packed within gap 96 is relatively porous acoustical insulation 90 typically consisting of layered steel wool and fiber glass, although basalt wood also has been found to serve as a very effective form of acoustical insulation. Typically, gap 96 has a length along a path of propagation of the sound waves, in this example the longitudinal axis of muffler 70, which is approximately one-tenth the wavelength of a pre-selected cut-off frequency, above which sound waves are to be attenuated.

Because of the porous nature of the acoustical insulation, some of the sound waves are absorbed into the insulation while others completely pass through the insulation 90. The partially attenuated waves which completely pass through the insulation also pass through perforations 99 in the third perforated partition 98 into a rear chamber 104. The perforations 99 on third partition 98 are typically larger than those contained on the second partition 94 and provide the third partition with an open surface area in the range of approximately 30%-70%.

Rear sound chamber 104, defined by the housing area located between the third transverse partition 98 and the second end wall 86, also has a relatively specific length. In order to obtain the best possible sound wave attenuation it has been found that the length of rear chamber 104 along the path of propagation of the sound waves—i.e. the longitudinal axis of muffler 70 should be approximately equal to one-fourth the wavelength of the cut-off frequency, above which sound waves are to be attenuated. Although the actual length of the rear chamber and the gap varies depending on the size of the muffler needed for different types of engines, the variables one-tenth wavelength for the gap length and one-quarter wavelength for the rear chamber length remain relatively constant for all muffler sizes.

Once inside rear chamber 104 the sound waves remain in motion reflecting off of the inside of end wall 86 and peripheral wall 88 thereby further attenuating the sound waves. As a result of bouncing off of the walls in the rear chamber 104, the sound waves become even less audible to the human ear because of increased attenuation. Because these now heavily attenuated sound waves are highly active, some of them tend to pass back through the perforated partitions 98 and 94 and the acoustical insulation 90 into the chamber 102 where, along with the exhaust gas, they pass through the exhaust outlet tube 108 which extends through all three partitions and the acoustical insulation into the receiving chamber 102.

Figure 4:
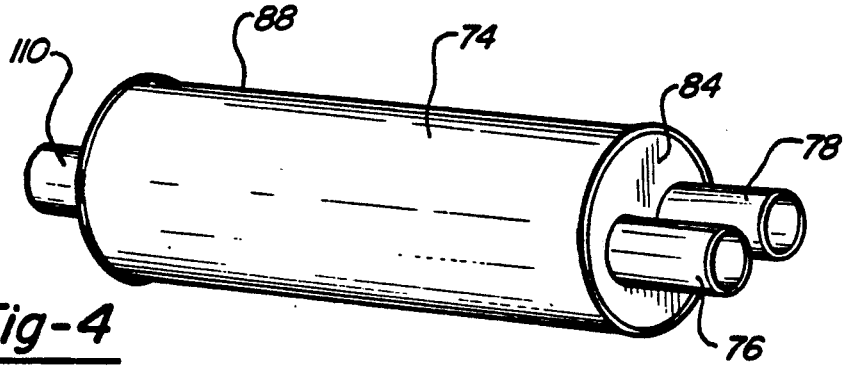
FIG. 4 is a perspective view of a second muffler housing assembly for the muffler of FIG. 1.
Figure 5:
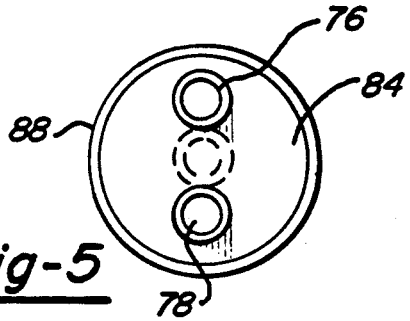
FIG. 5 is an end view of the muffler housing of FIG. 4.
Figure 3:
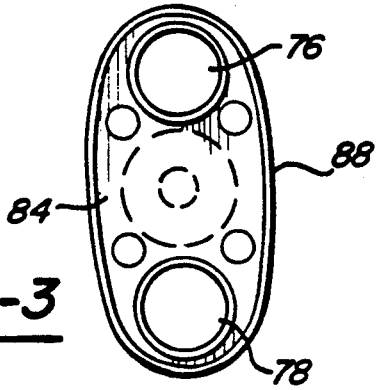
FIG. 3 is an end view of the muffler housing of FIG. 2.
Figure 2:
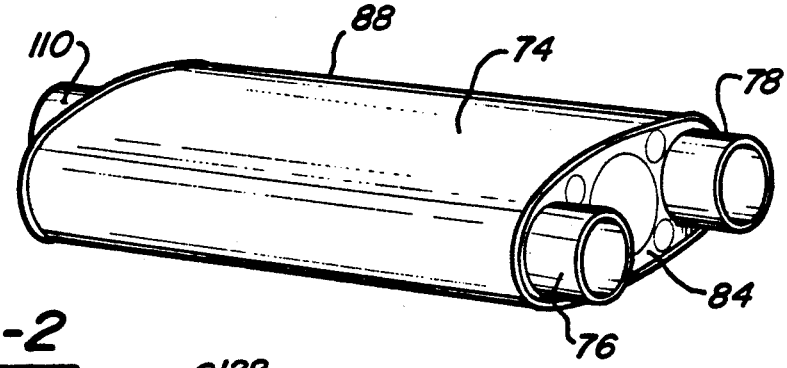
FIG. 2 is a perspective view of a first muffler housing assembly for the muffler of FIG. 1.
Figure 9:
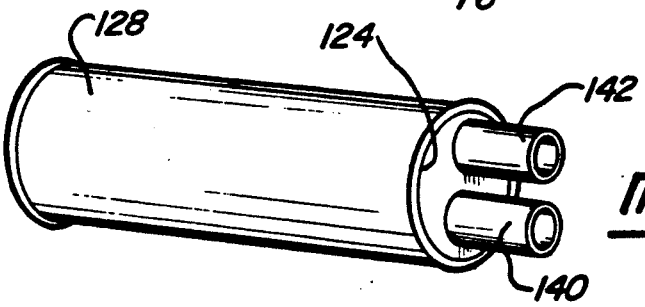
FIG. 9 is a perspective view of a second housing assembly for the muffler of FIG. 6.

As demonstrated in FIGS. 2 and 3, as well as FIGS. 4 and 5, the housing of the muffler shown in FIG. 1 can be of varying shapes. Generally, however, the muffler of FIG. 1 is in the form of either an elliptical or generally circular cylinder. However, it is to be noted that the invention contemplates chambers with lengths of ¼ and 1/10 wavelengths of a desired cutoff frequency which do not necessarily extend axially of the muffler housing. For example, such chambers could extend radially of a longitudinal axis of the muffler housing.

Figure 6:
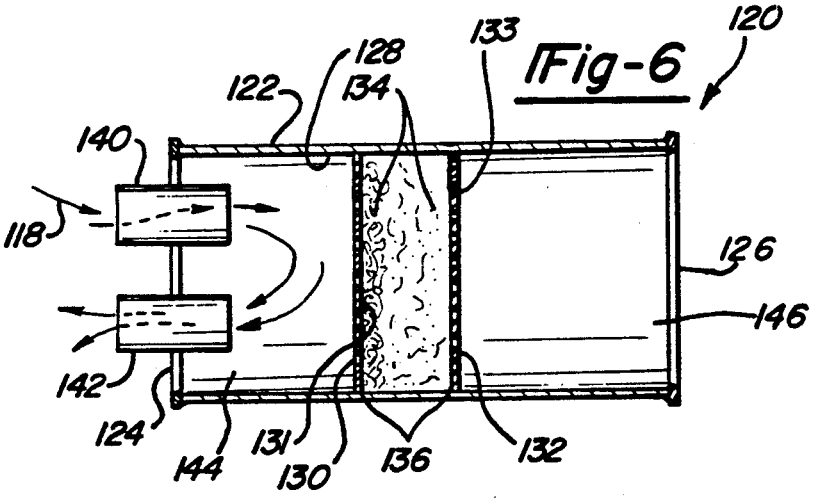
FIG. 6 is a side elevation view in cross-section of a second embodiment of a muffler incorporating diametrically positioned acoustical insulation arranged in accordance with the principles of the invention.

Referring to FIG. 6, a side elevation view of another embodiment of a muffler 120 having transversely positioned perforated partitions 130 and 132 and diametrically positioned acoustical insulation 134 is shown. The muffler housing 122 which comprises first and second end walls 124 and 126 and a third peripheral wall 128 extending between the two end walls is penetrated at a first end wall 124 by both an exhaust inlet tube 140 and an exhaust outlet tube 142. To ensure that the exhaust gas flows with virtually no back-up into the delivery pipe (not shown) the diameter of both the inlet tube 140 and outlet tube 142 is approximately equal to one-third the distance from the first end wall 124 to the first partition 130. Exhaust gas, demonstrated by arrows 118, and accompanying sound waves produced as a result of internal combustion engine operations enters the muffler housing 122 via the inlet tube 140. Both the exhaust gas and the accompanying sound waves are received into the muffler housing by a receiving chamber 144 which is defined by the area between the first end wall 124 and first transverse partition 130.

While the exhaust gas is temporarily contained within this receiving chamber 144 the sound waves pass through perforations 131 in the first partition 130. Enough perforations 131 are provided so that the sum of the perforation diameters is at least equal to the diameter of the inlet tube. Typically, the perforations 131 have a diameter on the order of 0.120 inches and provide for an open surface area of approximately 50%.

Once through this perforated partition 130 the sound waves are absorbed into acoustical insulation 134 which is contained within a gap 136. This gap 136, defined by the housing area located between the transversely located diametrically positioned first and second partitions 130 and 132 has a relatively specific length which is approximately equal to one-tenth the wavelength of the cut-off frequency, above which sound waves are to be attenuated.

The acoustical insulation 134 typically consists of layered steel wool and fiber glass, although basalt wood may also be used. Because the acoustical insulation is relatively porous in nature some of the sound waves are absorbed by the insulation while others pass completely through the insulation and through the perforations 133 in second partition 132. The perforations 133 are approximately 0.250 inches in diameter and provide the second partition 132 with approximately a 30% open surface area. It is to be understood that the preferred perforation size may vary from 0.060 inches to 0.300 inches to provide open surface areas of approximately 30% to 70%. In the process of passing through insulation 134 the sound waves which do pass completely through become partially attenuated.

After passing through the second partition 132 the partially attenuated sound waves enter a rear sound chamber 146. This rear chamber 146, defined by the area within the muffler housing located between the second transverse partition 132 and the second end wall 126 also has a very specific length. It has been discovered that maximum sound wave attenuation occurs when the length of the rear chamber 146 is approximately equal to one-fourth the wavelength of the cut-off frequency desired. The actual lengths for rear chamber 146 and gap 136 will vary depending on the desired cut-off frequency, however the variables one-tenth wavelength for the gap length and one-quarter wavelength for the rear chamber length remain relatively constant for all muffler sizes.

Inside the rear chamber 146 the partially attenuated sound waves reflect off the inside of end wall 126 and circumferential wall 128. This reflection off of the walls further attenuates the sound waves thereby lowering the audible level of the sound waves.

As a result of sound wave reflection within the rear chamber 146 many of the now heavily attenuated sound waves pass back through the partitions 132 and 130 via their perforations, through the acoustical insulation 134, and back into the receiving chamber 144. Once the attenuated sound waves have re-entered the receiving chamber 144 they then exit this chamber through the exhaust outlet tube 142 along with the exhaust gas.

Figure 8:
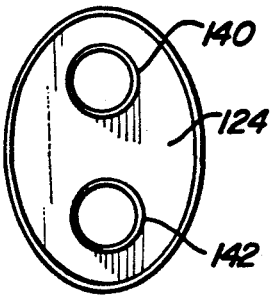
FIG. 8 is an end view of the housing assembly of FIG. 7.
Figure 10:
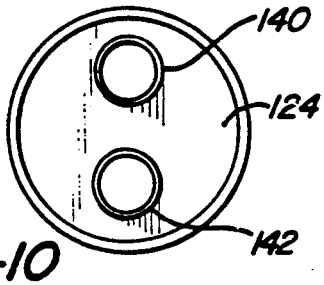
FIG. 10 is an end view of the housing assembly of FIG. 9.
Figure 7:
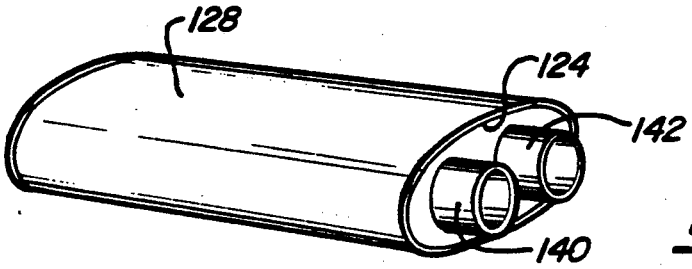
FIG. 7 is a perspective view of a first housing assembly for the muffler of FIG. 6.

As demonstrated by FIGS. 7 and 8 as well as 9 and 10, the muffler shown in FIG. 6 can be of varying shapes. Generally, however, the muffler of FIG. 6 is in the form of an elliptical or generally circular cylinder.

The invention has been described with reference to details of preferred embodiments which are for the sake of example only. The scope and spirit of the invention are to be determined by an appropriate interpretation of the appended claims.

What is claimed is:

1. A sound attenuating muffler for exhaust gas comprising a housing, at least one exhaust inlet tube and at least one exhaust outlet tube extending through an outer surface of the housing, first and second transverse perforated partitions within the housing extending across an interior dimension of the housing transverse to a flow of sound waves propagating therein and arranged such that a gap is provided between the partitions having a length in a direction of sound wave propagation on the order of 1/10 wave length of a preselected cutoff frequency, above which sound waves are to be attenuated; an exhaust receiving chamber defined between a first housing outer surface portion and the first partition; and a sound chamber defined between the second partition and a second housing outer surface portion having a length in the direction of sound wave propagation on the order of ¼ wavelength of the preselected cutoff frequency.

2. The muffler of claim 1 wherein the gap is provided with acoustic insulation

3. The muffler according to claim 1 wherein the perforations contained on the first partition are arranged such that said first partition is provided with an open surface area in the range of approximately 30 to 70% and the perforations contained on said second partition are arranged such that the second partition is provided with an open surface area in the range of approximately 30% to 70%.

4. The muffler according to claim 3 wherein the perforations contained on the first partition are smaller than the perforations contained on the second partition.

5. The muffler of claim 1 wherein the gap, the exhaust receiving chamber and the sound chamber are aligned along a longitudinal axis of the housing.

6. A sound attenuating muffler for exhaust gas comprising a housing having first and second end walls coupled to a third peripheral wall, wherein first and second exhaust inlet tubes extend through the first end wall and at least one exhaust outlet tube extends through the second end wall, and first, second and third perforated partitions arranged transversely to a longitudinal axis of the housing, wherein the transverse partitions extend diametrically across said hosing and are arranged such that a first exhaust receiving chamber is defined by a housing volume located between the first end wall and the first partition, an exhaust expansion chamber is defined by a housing volume between the first and second partitions, a gap for housing acoustic insulation is defined as a housing volume between the second and third partitions, and a sound wave attenuating chamber is defined as a housing volume between the third partition and the second end wall.

7. The muffler of claim 6 wherein the first partition contains axial bore means through which a first end of the first and second exhaust inlet tubes and a first end of at least one exhaust outlet tube extend, and the second and third partitions contain axial bore means through which the at least one exhaust outlet tube extends.

8. The muffler according to claim 6 wherein a length of the gap between the second and third partitions is approximately equal to 1/10th wave length of a preselected cutoff frequency, above which sound waves are to be attenuated.

9. The muffler according to claim 6 wherein a length of the sound wave attenuating chamber between the third partition and the second end wall is approximately equal to ¼ wavelength of a preselected cutoff frequency, above which sound waves are to be attenuated.

10. The muffler of claim 6 wherein the perforations contained on the second partition are arranged such that the second partition is provided with an open surface area in the range of approximately 30% to 70% and the perforations contained on the third partition are arranged such that said third partition is provided with an open surface area in the range of approximately 30% to 70%.

11. The muffler of claim 10 wherein the perforations contained on the second partition are smaller than the perforations contained on the third partition.

12. A sound attenuating muffler for exhaust gas comprising a housing having first and second end walls coupled to a third peripheral wall, wherein at least one exhaust inlet tube and at least one exhaust outlet tube extend through said first end wall, first and second perforated partitions arranged transversely to a longitudinal axis of the housing and positioned such that an exhaust receiving chamber is defined by a housing volume located between the first end wall and the first partition, a gap for holding acoustic insulation is defined by a volume between the first and second partitions, and a sound wave attenuating chamber is defined by a volume between the second partition and the second end wall.

13. The muffler of claim 12 wherein an axial length of the gap is approximately equal to 1/10th wave length of a preselected cutoff frequency, above which sound waves are to attenuated.

14. The muffler of claim 12 wherein an axial length of the sound wave attenuating chamber is approximately equal to ¼ wave length of a preselected cutoff frequency, above which sound waves are to be attenuated.

15. The muffler of claim 12 wherein the perforations contained on the first partition are arranged such that the first partition is provided with an open surface area in the range of approximately 30% to 70% and the perforations contained on the second partition are arranged such that the second partition is provided with an open surface area in the range of approximately 30% to 70%.

16. The muffler of claim 15 wherein the perforations contained on the first partition are smaller than the perforations contained on the second partition.

17. The muffler of claim 12 wherein perforations contained on the first partition form an open surface area at least equal to an area occupied by a cross section of the at least one exhaust inlet tube.

* * * * *